US006782724B2

(12) United States Patent
Kelly

(10) Patent No.: US 6,782,724 B2
(45) Date of Patent: Aug. 31, 2004

(54) SEMI-TRAILER LOCKING APPARATUS

(76) Inventor: Steven Michael Kelly, 424-11th St. W., Cornwall, Ontario (CA), K6J 3B8

( * ) Notice: Subject to any disclaimer, the term of this patent is extended or adjusted under 35 U.S.C. 154(b) by 0 days.

(21) Appl. No.: 10/269,260

(22) Filed: Oct. 11, 2002

(65) Prior Publication Data

US 2003/0070454 A1 Apr. 17, 2003

(30) Foreign Application Priority Data

Oct. 11, 2001 (CA) ..... 2358810

(51) Int. Cl.[7] ..... E05B 65/08

(52) U.S. Cl. ..... 70/100; 70/104; 70/106; 70/141; 292/DIG. 15; 292/DIG. 19

(58) Field of Search ..... 70/100, 94, 95, 70/DIG. 11, 104, 106, 134, 141, 142, 131; 292/DIG. 32, DIG. 15, DIG. 19

(56) References Cited

U.S. PATENT DOCUMENTS 387,371 A * 8/1888 Smith ..... 70/100
3,601,453 A * 8/1971 Silverman ..... 303/89
3,614,147 A * 10/1971 Spector ..... 292/254
4,009,599 A * 3/1977 Patriquin ..... 70/90
4,045,982 A * 9/1977 Gorton et al. ..... 70/90
4,583,381 A * 4/1986 Sjogren ..... 70/95
5,018,241 A * 5/1991 Baines ..... 16/82
5,062,669 A * 11/1991 McManigal et al. ..... 292/60
5,120,093 A * 6/1992 Carney ..... 292/60
5,490,304 A * 2/1996 Winner et al. ..... 16/82
5,590,918 A * 1/1997 Kambalov ..... 292/60
5,593,194 A * 1/1997 Liau ..... 292/340
5,682,775 A * 11/1997 Baber ..... 70/34
6,343,816 B1 * 2/2002 King ..... 292/165
6,378,919 B1 * 4/2002 Kitchen ..... 292/171

* cited by examiner

*Primary Examiner*—John B. Walsh
(74) *Attorney, Agent, or Firm*—Leydig, Voit & Mayer, Ltd.

(57) ABSTRACT

This invention involves a locking apparatus for semi-trailers and/or freight delivery units. A pin plate is attached to a standard trailer swing door, roll-up type door or another type of door. A housing is placed in the floor of the semi-trailer. A pin located within the housing is slidable within the housing from an unlocked position to a locked position, whereby the pin is raised to engage a pin plate secured to the semi-trailer door. A cam lock or another lock is used to keep the pin raised in the locked position.

6 Claims, 5 Drawing Sheets

SEMI-TRAILER LOCKING APPARATUS

FIELD OF THE INVENTION

This invention relates to apparatus for locking semi-trailers and/or freight delivery units.

BACKGROUND OF THE INVENTION

In the trucking industry, it is important that the contents of semi-trailers are secure from theft.

The most common approach has been to padlock the doors of the semi-trailer. Unfortunately, the lock remains accessible to thieves, who are able to cut the padlock with a pair of pliers or common tools.

It would be advantageous to have an apparatus for locking the doors of semi-trailers where the locking apparatus would be inaccessible to thieves.

SUMMARY OF THE INVENTION

It is an object of the invention to provide a locking apparatus which provides improved protection for the contents of semi-trailers and/or freight delivery units.

According to one embodiment of the invention, there is provided a locking apparatus for locking semi-trailer or freight delivery unit doors, comprising housing inserted through the floor of a semi-trailer and secured therein; plate means having a channel therein and positioned on the door of the semi-trailer adjacent to the housing; and pin means located within the housing, and being of a diameter less than the inner wall of the housing, and capable of moving from an unlocked position where the pin does not engage the plate means, to a locked position where the pin means engages the plate means such that the door of the semi-trailer or freight delivery unit can not be opened.

The pin means has at least one stop collar means located approximately mid-point along its length. A pin guide means is positioned towards the top of the housing and has a bore of sufficient diameter to permit passage of the pin means but not the stop collar means. Inner pin guide means is positioned towards the bottom of the housing, the pin guide means having a bore of sufficient diameter to permit passage of the pin means but not the stop collar means.

The pin guide means is positioned towards the top of the housing and secured on a pin guide seat means located below the top of the housing means.

The pin guide means and pin guide seat means have corresponding threaded bores through which a machine bolt means is threaded.

An optional spring means is positioned on the post means above the stop collar means.

A cam lock means is inserted in the bottom of the housing means until the cam lock means reaches the inner pin guide means, said cam lock means having a cam which engages a groove immediately below the inner pin guide means.

The housing means includes an upper adaptor means which fits over the top of the housing means, and a lower adaptor means which fits over the bottom of the housing means, the upper adaptor means and said lower adaptor means being welded into the floor of the semi-trailer.

Advantages of the invention are that the locking apparatus is inaccessible to thieves by being located in the floor of the semi-trailer and/or freight delivery units.

BRIEF DESCRIPTION OF THE DRAWINGS

Embodiments of the invention will now be described by way of example with reference to the following drawings in which.

DETAILED DESCRIPTION

Figure 1:
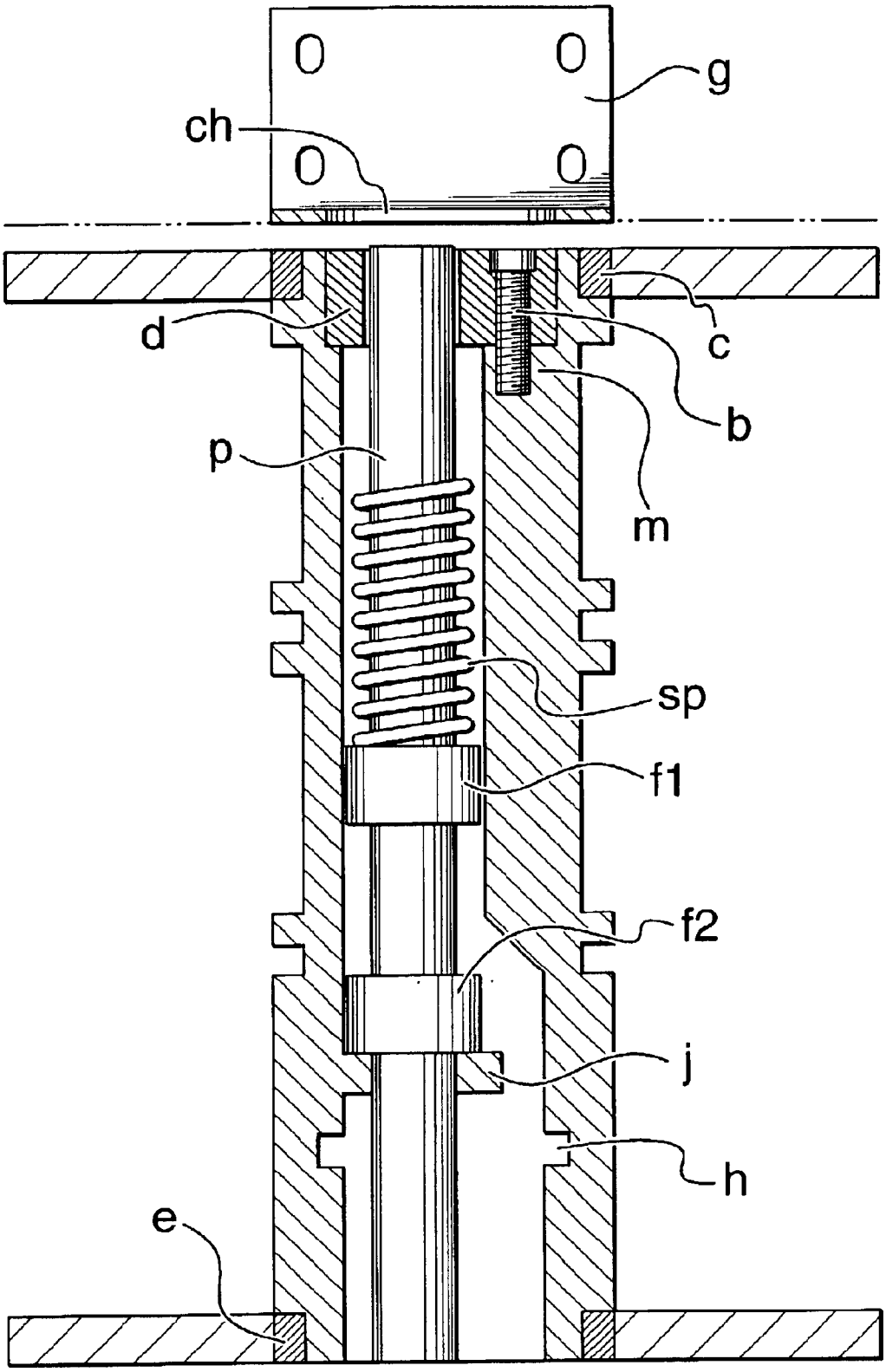
FIG. 1 is a cross-section of the locking apparatus in the unlocked position, as used on a standard semi-trailer swing door.

Referring to FIG. 1, there is shown the locking apparatus in the unlocked position. A housing (a) is inserted in a hole in the floor of a semi-trailer (not shown). An upper adaptor (c) is placed over the upper end of the housing (a) and is welded to the floor of the semi-trailer. A lower adapter (e) fits over the bottom of the housing (a) and is welded to the bottom of the semi-trailer floor to aid in installation of different type metal floors. Preferably, the housing (a), upper adaptor (c) and lower adaptor(e) are made of steel or another suitable material.

A pin (p) is slidable vertically within said housing (a) and is maintained in place by means of a pin guide (d) and an inner pin guide (j) which have first corresponding holes through which the pin (p) passes. The pin guide (d) is placed inside the housing (a) and is secured in place by means of a recessed machine bolt (b), which passes through a second corresponding hole in the pin guide (d) and engages a pin guide seat (m). Preferably, the pin (p) is made of steel or another suitable material. Preferably, the pin guide (d) is made of nylon, although steel or another suitable material could be used.

In the unlocked position, the pin (p) rests in its lower position such that the second stop collar (f2) rests on the inner guide (j). The pin (p) is the same length as the housing (a) such that in the unlocked position, the top of the pin (p) is flush with the top of the housing (a) while the bottom of the pin (p) is flush with the bottom of the housing (a).

An optional spring or springs can be placed over the pin (p) and rests on the first stop collar (f1).

Also shown in FIG. 1 is a cam groove (h) which is used by a cam lock (l) when inserted. In the preferred embodiment the groove is cut 360° around the housing, but it will be understood that the groove could be cut less than 360° and still function.

A pin plate or pin receiver (g) is fitted to the door of the semi-trailer and has a channel (ch) to receive the pin (p). The holes in the pin plate (g) are positioned to correspond to the existing cover plates which are used in the industry.

Figure 2:
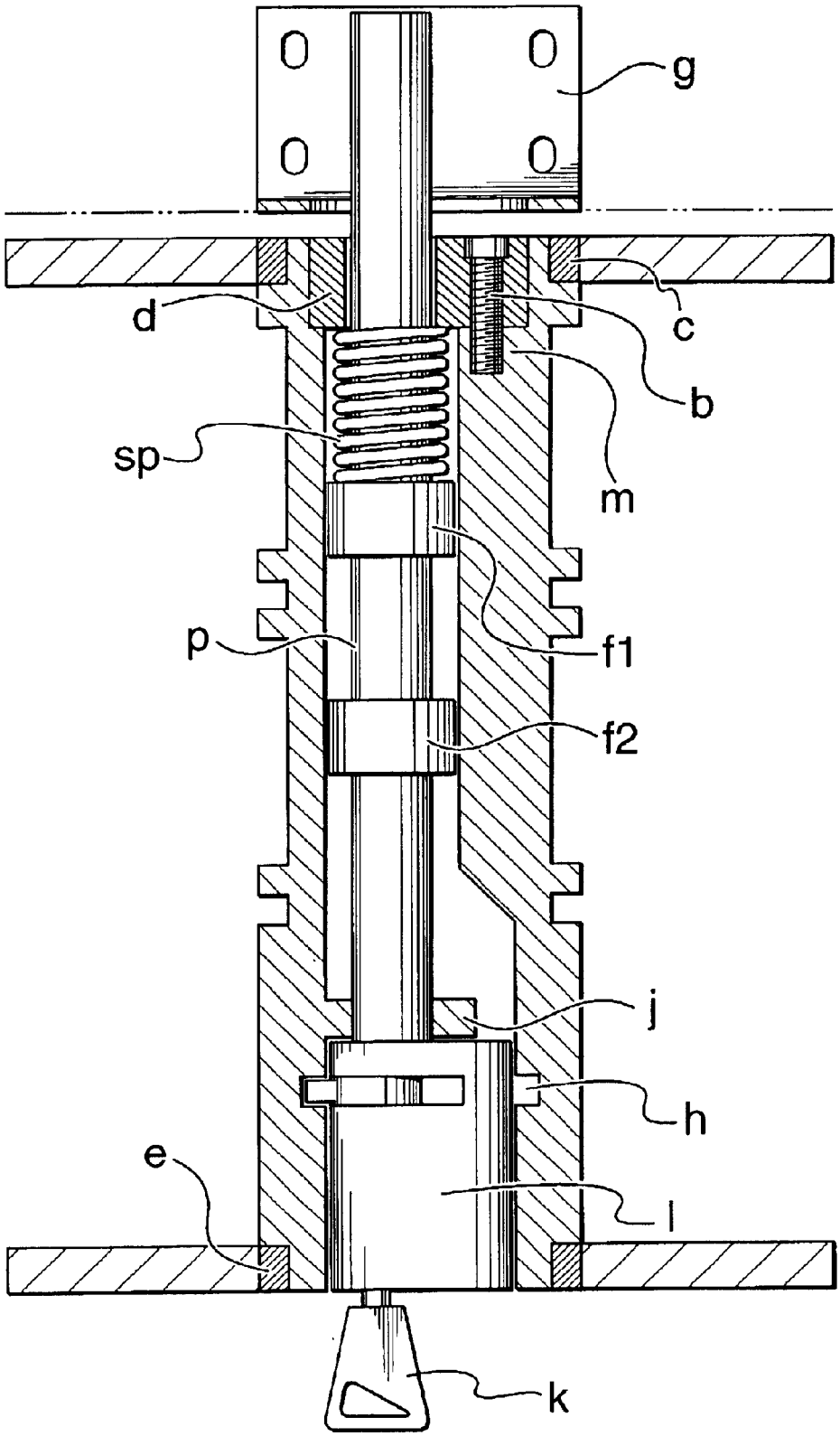
FIG. 2 is a cross-section of the locking apparatus in the locked position, as used on a standard semi-trailer swing door.

Referring to FIG. 2, there is shown the locking apparatus in the closed position. A cam lock (l) has been inserted into the bottom of the housing (a) and, when the key is turned, the cam (t) engages the cam groove (h).

By the insertion of the cam lock (l), the pin (p) is pushed to its upper position such that the top section of the pin (p) slides within the channel (ch) of the pin plate (g). The first stop collar (f1) on the pin (p) rests against the bottom of the pin guide (d).

In use, the locking apparatus begins in the unlocked position as shown in FIG. 1. In this position the pin (p) is not engaged in the pin plate (g) and the doors of the semi-trailer may be freely opened and closed.

When it is desired to lock the doors of the semi-trailer, as shown in FIG. 2, a cam lock (l) (such as an Abloy™ Lock 5425 NK Oval Single Cylinder) is inserted into the bottom of the housing (a) and locked by means of a key such that the cam (t) engages the cam groove (h). By inserting the cam lock (l), the cam lock (l) pushes the pin (p) from its unlocked position, where the second stop collar (f2) is resting on the inner pin guide (j), to a raised position where the first stop collar (f1) touches the pin guide (d). In so doing, the top of the pin (p) extends above the height of the floor of the semi-trailer and is inserted in the channel (ch) of the pin plate (g).

When the semi-trailer is to be unlocked, the process is reversed. The cam lock (l) is unlocked by means of a key and the cam (t) disengages from the cam groove (h). The cam lock (l) then drops out of housing (a). The pin (p) then drops, disengaging from the channel (ch) of the pin plate (g), and causing the second stop collar (f2) to come to rest on the inner pin guide (j). At this point, the doors of the semi-trailer may again be freely opened and closed.

The optional spring (s) biases the pin (p) towards the unlocked position and helps to disengage the pin (p) from the pin guide (g).

Figure 3:
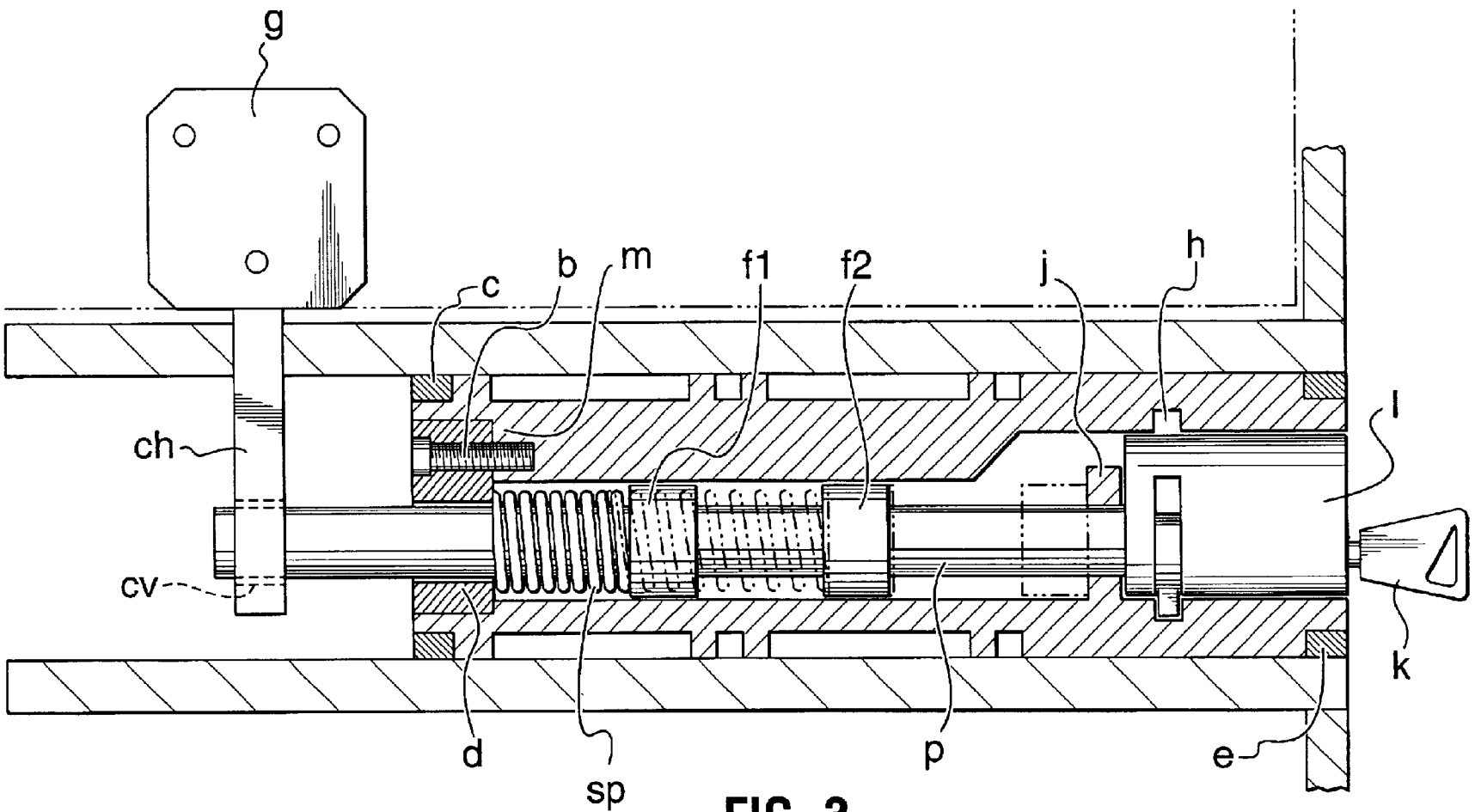
FIG. 3 is a cross-section of the locking apparatus in the locked position, as used on a roll-up trailer door.

As shown in FIG. 3, the locking apparatus may be used with roll-up type trailer doors.

The housing (a) is inserted sideways into the trailer floor.

The pin plate (p) which attaches to the roll-up door has a channel (ch) below the face of the plate (p) which receives the pin (p). The channel (ch) fits in a cavity (cv) made in the floor of the trailer.

The use of the spring (s) is particular useful for roll-up doors because the pin (p) is not aided by gravity to return to its unlocked position.

In another embodiment of the invention, the size and shape of the housing could be adapted to fit different floor sizes. In such cases, the pin (p) could be made with a single stop collar.

Figure 4:
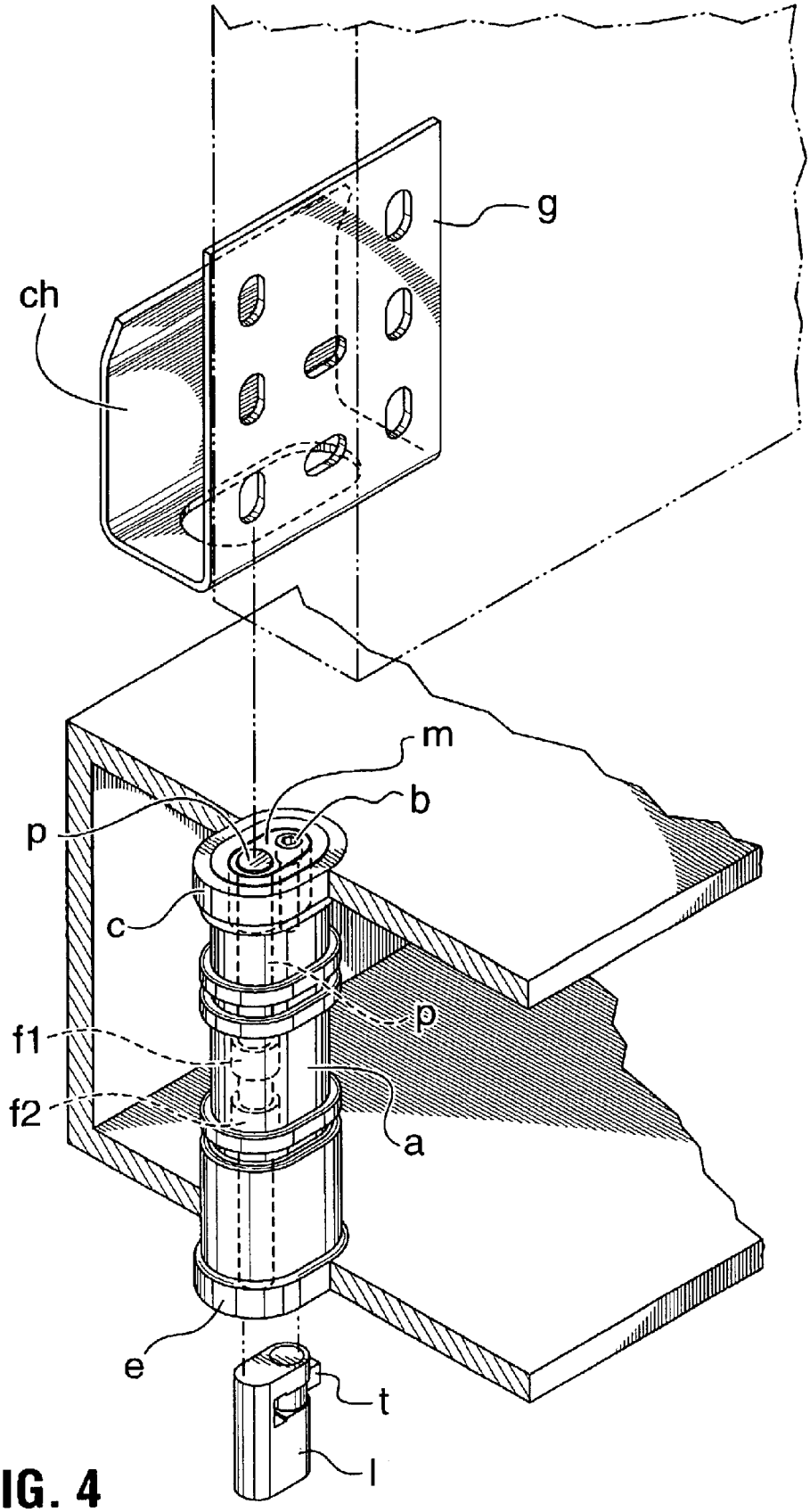
FIG. 4 is a perspective view of the locking apparatus of FIG. 1 in the locked position, showing the trailer floor.

FIG. 4 shows a perspective view of the locking apparatus in the locked position, showing the trailer floor.

It will be understood that, instead of using a pin plate, a hole could be drilled through the bottom of the door of a semi-trailer or freight delivery unit to receive the pin.

It is a unique feature of the locking device that all cam locks fit all housings, regardless of whether they are swing doors, roll-up doors, or any other type.

Figure 5:
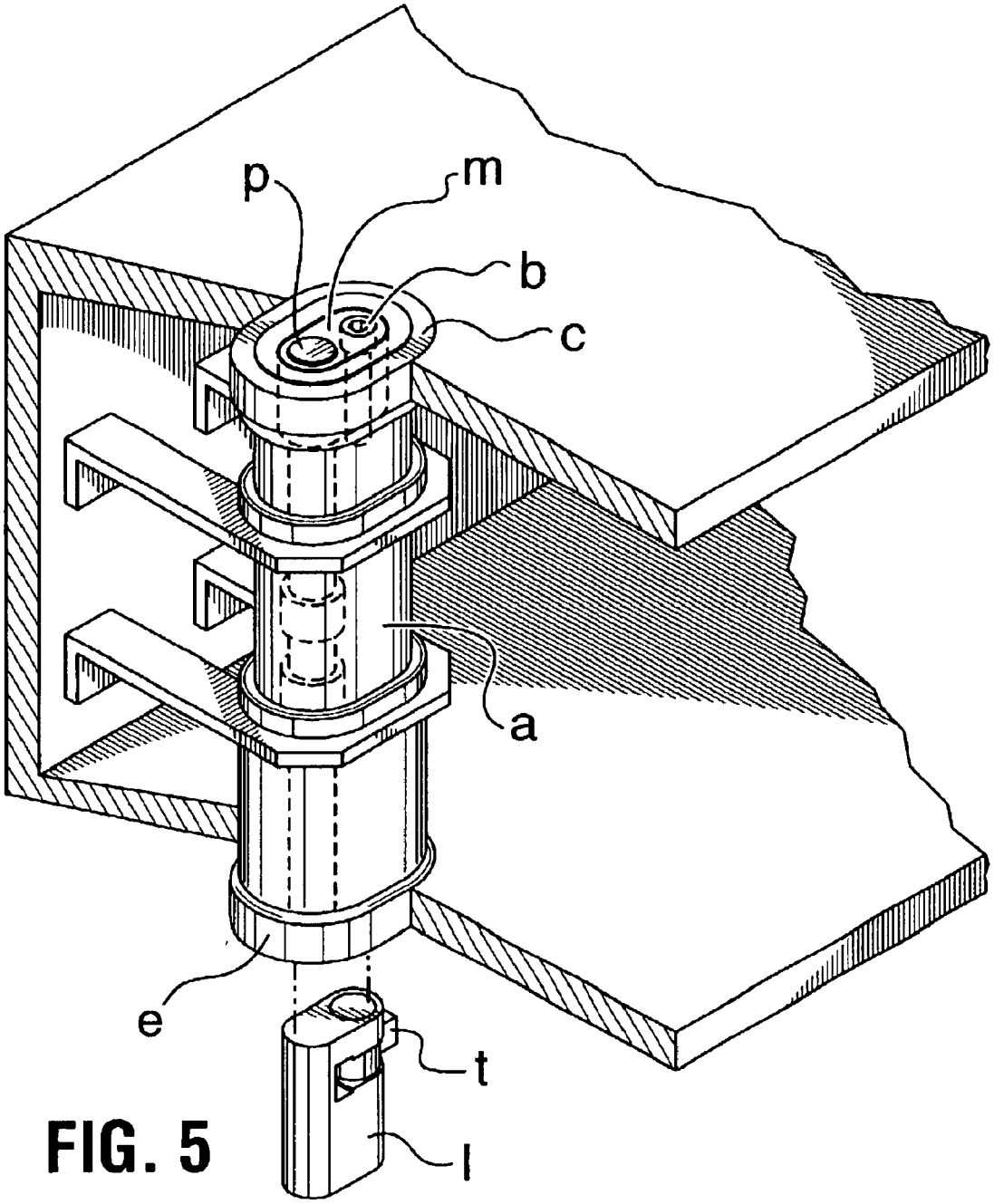
FIG. 5 is a perspective view of the locking apparatus showing the trailer floor as shown in FIG. 4, including further mounting members.

To ensure a more secure fit, geneally U-shaped members can be inserted through grooves in the housing (a) and welded to the sides of the truck body as shown in FIG. 5.

While the invention has been described for use with semi-trailers and/or freight delivery units, it will be understood that the invention could be used, for example, with gates or in any other situation where it is desired to lock one item to another.

It will be understood by the person skilled in the art that a number of modifications and variations could be made without departing from the scope or intention of the invention.

The embodiments of the invention in which an exclusive property or privilege is claimed are defined as follows:

1. A locking apparatus for locking at least one door of a semi-trailer or freight delivery unit, the semi-trailer or freight delivery unit having a floor, the locking apparatus comprising:

(a) a housing inserted through the floor and secured therein, the housing having an inner wall;

(b) a plate having a channel therein and positioned on the door of the semi-trailer adjacent to the housing when the door is closed;

(c) a pin mechanism located within the housing and being of a diameter less than the inner wall of the housing, and capable of moving from an unlocked retracted position where the pin mechanism does not engage the plate, to a locked position where the pin mechanism engages the plate such that the door can not be opened;

(d) wherein the pin mechanism has at least one stop collar located approximately mid-point along the length of the pin mechanism, the locking apparatus further comprising:

(i) a pin guide positioned towards the top of the housing, said pin guide having a bore of sufficient diamater to permit passage of the pin mechanism but not the stop collar;

(ii) an inner pin guide positioned towards the bottom of the housing, said pin guide having a bore of sufficient diamater to permit passage of the pin mechanism but not the stop collar; and a cam lock, said cam lock being inserted in the bottom of the housing until the cam lock reaches the inner pin guide, said cam lock having a cam which engages a groove immediately below the inner pin guide.

2. The locking apparatus according to claim 1 wherein the pin guide is secured on a pin guide seat located below the top of the housing.

3. The locking apparatus according to claim 2 wherein the pin guide and pin guide seat have corresponding threaded bores through which a machine bolt is threaded.

4. The locking apparatus according to claim 1 further comprising a spring mechanism positioned on a post above the stop collar.

5. The locking apparatus according to claim 1 wherein the housing includes an upper adaptor which fits over the top of the housing, and a lower adaptor which fits over the bottom of the housing, said upper adaptor and said lower adaptor being welded to the floor.

6. The locking apparatus according to claim 1 wherein the housing includes an upper adaptor which fits over the top of the housing, and a lower adaptor which fits over the bottom of the housing, said upper adaptor and said lower adaptor being welded to the floor.

* * * * *